US005229819A

United States Patent [19]

Beresniewicz et al.

[11] Patent Number: 5,229,819

[45] Date of Patent: Jul. 20, 1993

[54] PROTECTIVE ASSEMBLY FOR CHARGING APPARATUS

[75] Inventors: Jon M. Beresniewicz; David A. D'Angelantonio; Patricio G. Medina, all of Webster; Christian O. Abreu, Rochester, all of N.Y.

[73] Assignee: Xerox Corporation, Stamford, Conn.

[21] Appl. No.: 755,387

[22] Filed: Sep. 5, 1991

[51] Int. Cl.[5] ..... G03G 15/02

[52] U.S. Cl. ..... 355/224; 250/324; 361/221; 361/230; 355/274

[58] Field of Search ..... 355/219, 221, 222, 223, 355/224, 225, 226, 274; 250/324, 325, 326; 361/220, 221, 230, 233

[56] References Cited

U.S. PATENT DOCUMENTS

| | | | |
|---|---|---|---|
| 2,934,650 | 4/1957 | De Witt | 250/325 |
| 3,137,806 | 6/1964 | Schweriner | 361/230 |
| 3,643,128 | 2/1972 | Testone | 250/326 X |
| 3,691,373 | 9/1972 | Compton et al. | 250/326 |
| 3,792,312 | 2/1974 | Marx | 361/230 |
| 4,424,549 | 1/1984 | Ensing | 361/230 |
| 4,725,732 | 2/1988 | Lang et al. | 250/326 |
| 4,906,841 | 3/1990 | Taniguchi et al. | 250/326 X |
| 5,126,794 | 6/1992 | Altmann | 355/221 |

FOREIGN PATENT DOCUMENTS

| | | | |
|---|---|---|---|
| 0210458 | 11/1984 | Japan | 355/221 |

*Primary Examiner*—A. T. Grimley
*Assistant Examiner*—J. E. Barlow
*Attorney, Agent, or Firm*—Denis A. Robitaille

[57] ABSTRACT

A corotron assembly comprising a coronode for generating an electrostatic field and including an electrically nonconductive protective guard having a U-shaped base member forming a channel for receiving the coronode wherein a plurality of finger elements are provided, extending from the sidewalls such that the coronode is recessed between the finger elements. Each finger element is further provided with a spherical radii tip for reducing the attenuating effects of the finger elements on the electrostatic field generated by the coronode.

26 Claims, 4 Drawing Sheets

PROTECTIVE ASSEMBLY FOR CHARGING APPARATUS

The present invention relates generally to corona charging devices, and more particularly concerns a protective assembly for use in a charging apparatus utilized in electrostatographic applications.

Generally, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. The electrostatic latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step, the photoconductive surface of the photoreceptive member is cleaned to remove any residual developing material therefrom in preparation for successive imaging cycles.

The described process is well known and is useful for light lens copying from an original, as well as for printing documents from electronically generated or stored originals. Analogous processes also exist in other electrostatographic applications such as, for example, ionography where charge is selectively deposited on a charge retentive surface in accordance with an image stored in electronic form.

In electrostatographic applications, it is common practice to use wire corona generating devices for providing electrostatic fields to drive various machine operations. Such corona devices are primarily used to deposit charge on the photoreceptive member prior to exposure to the light image for subsequently enabling toner transfer thereto. In addition, corona devices are used in the transfer of an electrostatic toner image from a photoreceptor to a transfer substrate, in tacking and detacking paper to or from the imaging member by applying a neutralizing charge to the paper, and, generally, in conditioning the imaging surface prior to, during, and after toner is deposited thereon to improve the quality of the xerographic output copy. Because a relatively large number of corona generating charging devices are required to accomplish all of the operations in a single electrostatographic machine, it is advantageous for these devices to be provided as inexpensively as possible.

The conventional form of corona generating charging device used in electrostatographic reproduction systems is generally shown in U.S. Pat. No. 2,836,725. That patent discloses a basic corotron device wherein a conductive corona electrode in the form of an elongated wire is partially surrounded by a conductive shield. The corona electrode, or so called coronode, is provided with a DC voltage, while the conductive shield is usually electrically grounded and the dielectric surface to be charged is spaced proximate to the wire. Alternatively, the corona device may be biased in a manner taught in U.S. Pat. No. 2,879,395, which describes a device known as a scorotron, wherein an AC corona generating potential is applied to the conductive wire electrode while a DC biasing potential is applied to a conductive shield partially surrounding the electrode. This DC potential regulates the flow of ions from the electrode to the surface to be charged so that the charge rate can be adjusted, making this biasing system ideal for self-regulating systems. Various other charging and biasing arrangements are known in the art and will not be discussed in great detail herein.

In one type of preferred charging device, an electrically conductive electrode strip or coronode may be provided having projections, scalloped portions, or teeth members integrally formed with, and extending from, an edge of the coronode. This arrangement provides significant structural and operational advantages over other types of coronode devices such as wire electrodes. These advantages include comparatively high structural strength and reduced levels of undesirable ozone emissions. In this respect, U.S. Pat. No. 3,691,373 to Compton et al. demonstrates a corona device generally comprising an electrically conductive electrode strip or pin array supported on either side by support strips, and mounted within an electrically nonconductive base member. One of the side strips is adapted for connection to an exterior connector from a high voltage source. The electrode is fixed into position within the base member by a plurality of transverse pins which fit through matching holes in the base member, the pin array, and the support strips. The corona device disclosed therein may further include a screen and/or an auxiliary coronode as well as various additional conductive shields for regulating charging current to control uniformity of charge.

Several problems have historically been associated with the unique design of pin coronode devices. The most notable problem associated with these devices centers around the inherent safety problems associated with the very sharp, saw-tooth-like pin array which makes up the pin coronode. As a result, a protective shield is generally required for preventing external contact with the pin array by a field service technician or any other individual which may result in lacerations or other injuries or for preventing external contact by any other physical object which may cause damage to the pin coronode. Most commonly, the corona generating assembly will include a protective lacing mounted so as to cover the pin array, wherein the protective lacing is generally comprised of a nonconductive material forming a grid having openings generally small enough to prevent contact with the exposed teeth of the pin array. It is also recognized that non-prior art structures may also be suitable; for example, a nonconductive molded beam supported directly over the coronode could provide sufficient safety protection.

Unfortunately, however, such protective lacing and other structures which are positioned over the coronode have been shown to create an adverse attractive force on the electric field lines emitted from the coronode such that a banding after-effect commonly known as "lace printout", can be seen on an output copy. While lace printout, and the resultant quality problems associated therewith, may often be minimal and inconsequential, the effects of lace printout are exacerbated and become more pronounced in state-of-the-art color machines wherein a photoconductive surface is recharged, and an image is exposed and developed up to four separate times to produce an output copy.

Thus, it is highly desirable to provide an effective and inexpensive protective guard for preventing external contact with the coronode of a corona generating charging device, while eliminating the attractive effects of the protective guard structure on the electric field generated by the coronode. The following disclosures may be relevant to various aspects of the present invention:

U.S. Pat. No. 2,934,650
Patentee: DeWitt
Issued: Apr. 26, 1960
U.S. Pat. No. 3,691,373
Patentee: Compton, et al.
Issued: Sep. 12, 1972
U.S. Pat. No. 4,424,549
Patentee: Ensing
Issued: Jan. 3, 1984
U.S. Pat. No. 4,725,732
Patentee: Lang, et al.
Issued: Feb. 16, 1988

The relevant portions of the foregoing disclosures may be briefly summarized as follows:

U.S. Pat. No. 2,934,650 discloses a charging apparatus for applying a uniform electrostatic charge to surfaces used in xerography and, in particular, provides a charging apparatus for sensitizing xerographic plates through the application of a uniform electrostatic charge to the surface of the photoconductive insulating layer. The charging device of that patent comprises a plurality of charging needles connected by an electrically conductive connector to a high-voltage power supply. The potential supplied by the power supply to the needles is sufficient to produce corona discharge at the lower ends of the needles which are, preferably, quite fine or pointed.

U.S. Pat. No. 3,691,373 discloses a corona charging device comprising an electrically nonconductive base member having a corona generating member mounted in the central slot thereof. The corona generating member comprises an electrically conductive central strip having a number of projections along the top edge, being supported by a pair of side strips positioned on either side. The corona generating member is held together and fastened to the nonconductive base member by a number of transverse pins fitted into matching holes in the central and side strips.

U.S. Pat. No. 4,424,549 discloses a corona generating device comprising a multiplicity of electrode pins embedded in a body of insulating material wherein each pin projects from two sides of the insulating body. The body is disposed between two conductive elements, or electrodes, which, in turn, are connected to the opposite poles of a voltage source. The end of each pin is located in the electric field between the electrodes at locations between which a high potential difference is present, so that a corona discharge may develop between each end of a pin and the related electrode. Each electrode pin generates an ion cloud which extends from the pin towards a counter-electrode, and a material to be charged, such as a photoconductive element.

U.S. Pat. No. 4,725,732 discloses a corona charging device including at least one pin array electrode having interlocking pin array support members and integral pin projections. That patent specifically shows the use of a protective lacing as described hereinabove, wherein the protective lacing is generally comprised of a nonconductive material in the form of a grid having openings generally small enough to prevent external contact with the exposed teeth of the pin array by a finger or hand.

In accordance with the present invention, a corona generating assembly is disclosed including a coronode and a protective guard wherein the protective guard comprises a base member having an open-ended aperture which may include at least one pair of sidewalls and a plurality of elements from the base member on opposed sides of the aperture with the coronode being recessed between these elements. The fingers of the protective guard project some distance above the coronode to prevent external contact therewith. In accordance with another aspect of the invention, an electrostatographic printing apparatus is provided with at least one of the corona generating assemblies having a protective guard as described herein.

In accordance with a particular aspect of the invention, a corona generating assembly is disclosed, including a protective guard for housing a pin coronode, wherein the protective guard comprises a plurality of fingers alternately interspaced about either side of the pin coronode.

In accordance with yet another aspect of the invention, a protective guard is disclosed comprising a base member, including an aperture having opposing sidewalls with elements projecting therefrom. Each of the elements are finger-shaped projections having a spherical radii tip.

These and other aspects of the present invention will become apparent from the following description in conjunction with the accompanying drawings in which.

Figure 1A:
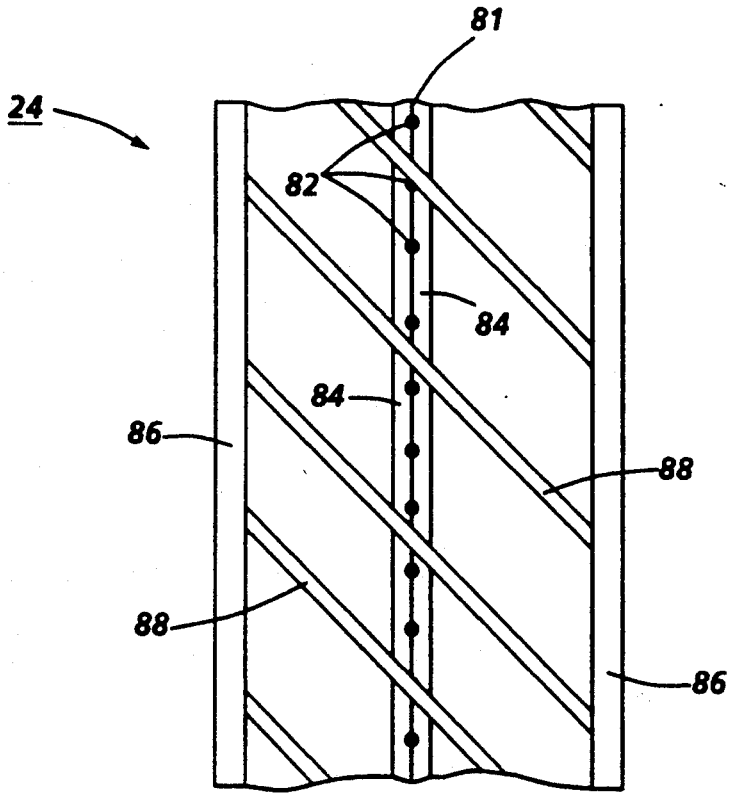
FIG. 1A (Prior Art)
FIGS. 1A and 1B are top and side views, respectively, of a prior art corona generating assembly.

For a general understanding of the features of the present invention, reference is made to the drawings wherein like reference numerals have been used throughout the several figures to designate corresponding elements of a preferred embodiment. While the present invention will be described in terms of a specific preferred embodiment, it will be understood that the invention is not to be limited to this preferred embodiment. On the contrary, the present invention is intended to cover all alternatives, modifications, and equivalents as may be included within the spirit and scope of the invention as defined by the appended claims.

Figure 6:
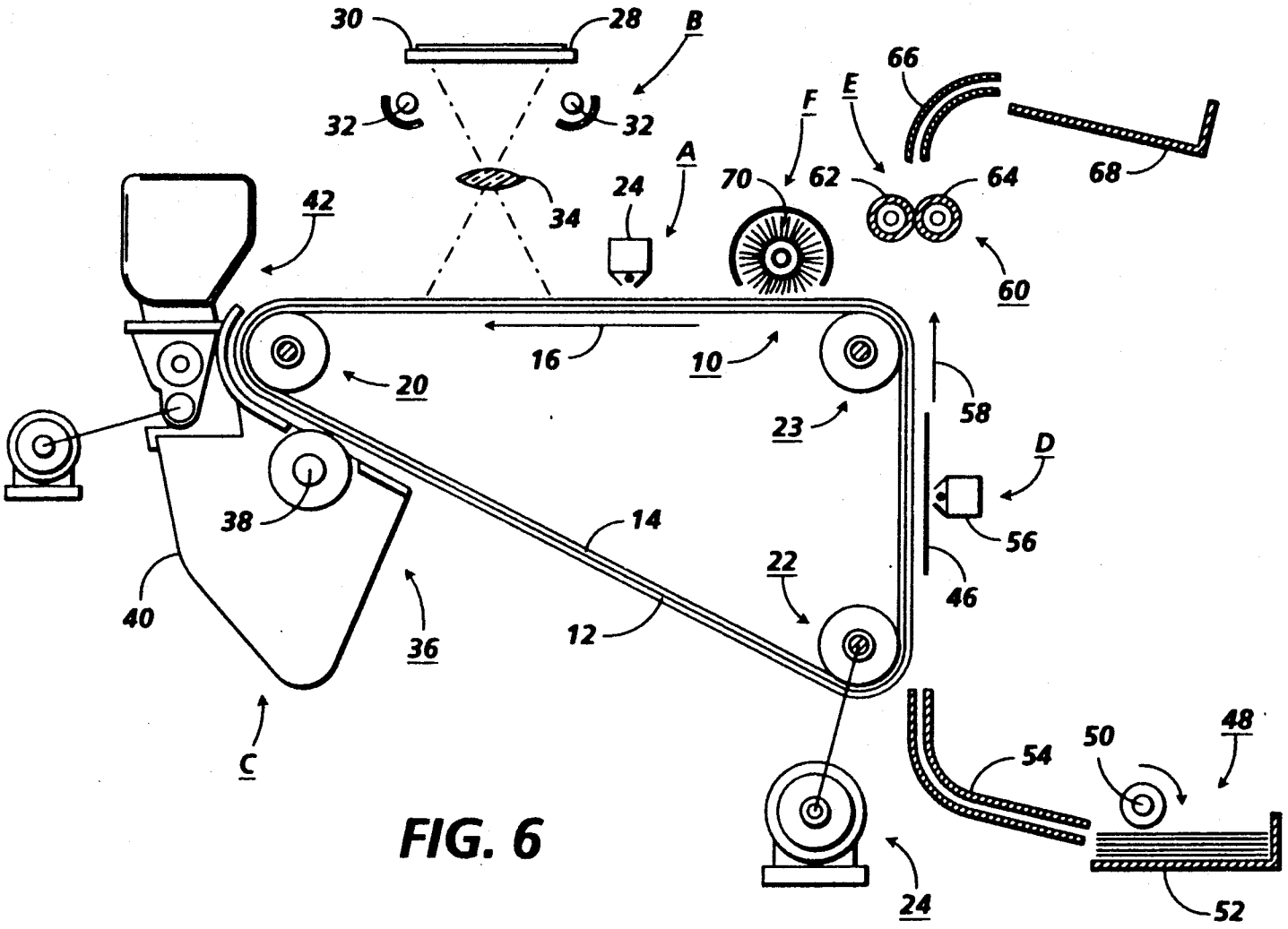
FIG. 6 is a schematic view showing an electrophotographic coping apparatus employing the corona generating assembly of the present invention.

Referring initially to FIG. 6, before describing the specific features of the present invention, a schematic depiction of the various components of an exemplary electrophotographic reproducing apparatus incorporating the corona generating assembly of the present invention is provided. Although the apparatus of the present invention is particularly well adapted for use in an automatic electrophotographic reproducing machine, it will become apparent from the following discussion that the present corona generating assembly is equally well suited for use in a wide variety of electrostatographic processing machines as well as any other systems requiring the use of a charging device and the invention is not necessarily limited in its application to the particular embodiment or embodiments shown herein. In particular, it should be noted that the corona generating assembly of the present invention, described hereinafter with reference to an exemplary charging system, may also be used in the toner transfer, detack, or cleaning subsystems of a typical electrostatographic coping or printing apparatus since such subsystems also require the use of a corona generating device. It will be further recognized that the protective guard disclosed in the present invention may also be utilized independent of a corona generating apparatus, in various system, devices, and configurations requiring the protection of an elongated member therein.

The exemplary electrophotographic reproducing apparatus of FIG. 6 employs a belt 10 including a photoconductive surface 12 deposited on an electrically grounded conductive substrate 14. Drive roller 22, coupled to motor 24 by any suitable means, as for example a drive belt, engages with belt 10 to move belt 10 about a curvilinear path defined by the drive roller 22, and rotatably mounted tension rollers 20, 23. This system of rollers is used for advancing successive portions of photoconductive surface 12 in the direction of arrow 16 through various processing stations disposed about the path of movement thereof, as will be described.

Initially, a segment of belt 10 passes through charging station A. At charging station A, a corona charging assembly in accordance with the present invention, indicated generally by reference numeral 24, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from this light source are reflected to form a light image of the original document and transmitted through a lens 34 which focuses the light image onto the charged portion of photoconductive surface 12, selectively dissipating the charge thereon. This process records an electrostatic latent image corresponding to the original document 28 onto photoconductive surface 12. Although an optical system has been shown and described for forming the light image of the information used to selectively discharge the charged photoconductive surface 12, one skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, belt 10 advances to development station C where a magnetic brush development system, indicated generally by reference numeral 36, deposits developing material onto the electrostatic latent image. Magnetic brush development system 36 includes a single developer roller 38 disposed in developed housing 40. In the developer housing 40, toner particles are mixed with carrier beads, generating an electrostatic charge therebetween which causes the toner particles to cling to the carrier beads to form developing material. The developer roller 38 rotates and attracts this developing material to form a magnetic brush having carrier beads and toner particles magnetically attached thereto. Thus, as the developer roller 38 rotates, developing material is brought into contact with the photoconductive surface 12 such that the latent image thereon attracts the toner particles of the developing material and the latent image on photoconductive surface 12 is developed into a visible image. A toner particle dispenser, indicated generally by the reference numeral 42, furnishes a supply of additional toner particles to housing 40 to sustain the developing process.

After the toner particles have been deposited onto the electrostatic latent image for development thereof, belt 10 advances the developed image to transfer station D, where a sheet of support material 46 is moved into contact with the developed toner image via sheet feeding apparatus 48 and chute 54. Preferably, sheet feeding apparatus 48 includes a feed roller 50 for rotation while in contact with the uppermost sheet of stack 52 to advance the uppermost sheet into chute 54. Chute 54 directs the advancing sheet of support material 46 into contact with photoconductive surface 12 of belt 10 in a timed sequence so that the developed image thereon contacts the advancing sheet of support material 46 and is transferred thereon at transfer station D. A corotron 56 is provided for projecting ions onto the backside of sheet 46 to aid in inducing the transfer of toner from the photoconductive surface 12 to support material 46. It will be understood by those of skill in the art that the pin corotron assembly of the present invention can be utilized as corotron 56. The support material 46 is subsequently transported in the direction of arrow 58 for placement onto a conveyor (not shown) which advances the sheet to a fusing station E.

Fusing station E includes a fuser assembly, indicated generally by the reference numeral 60, for permanently affixing the transferred image to sheet 46. Fuser assembly 60 preferably comprises a heated fuser roller 62 and a support roller 64 spaced relative to one another for receiving a sheet of support material 46 therebetween. The toner image is thereby forced into contact with the support material 46 between fuser rollers 62 and 64 to permanently affix the toner image to support material 46. After fusing, chute 66 directs the advancing sheet of support material 46 to receiving tray 68 for subsequent removal of the finished copy by an operator.

Invariably, after the support material 46 is separated from the photoconductive surface 12 of belt 10, some residual developing material remains adhered to belt 10. Thus, a final processing station, namely cleaning station F, is provided for removing residual toner particles from photoconductive surface 12 subsequent to separation of the support material 46 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle.

The foregoing description should be sufficient for purposes of the present application for patent to illustrate the general operation of an electrophotographic reproducing apparatus incorporating the features of the present invention. As described, the electrophotographic reproducing apparatus may take the from of any of several well known devices or system. Variations of specific electrostatographic processing subsystems or processes may be expected without affecting the operation of the present invention.

Figure 1B:
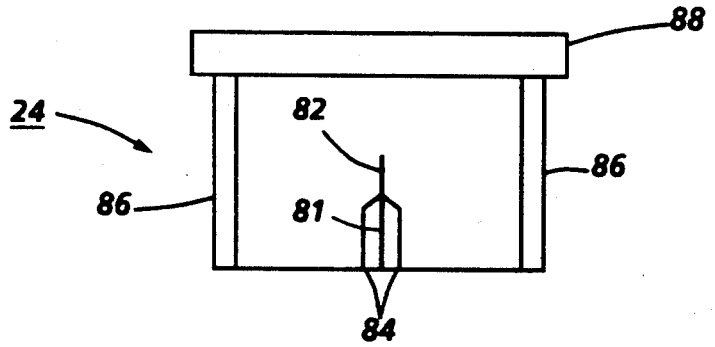
FIG. 1B (Prior Art)

FIGS. 1*a* and 1*b* illustrate prior art configuration of a pin coronode device having a protective lace as previously discussed herein. The prior art device shown comprises a pin coronode 81 including a pin array 82, supported by side support members 84 and positioned between shield member 86. Pin coronode 81 preferably comprises of a thin, elongate member fabricated from a highly conductive material having triangular teeth or scalloped edges along one edge thereof and extending the entire length of the member towards a surface to be charged (not shown).

Figure 5:
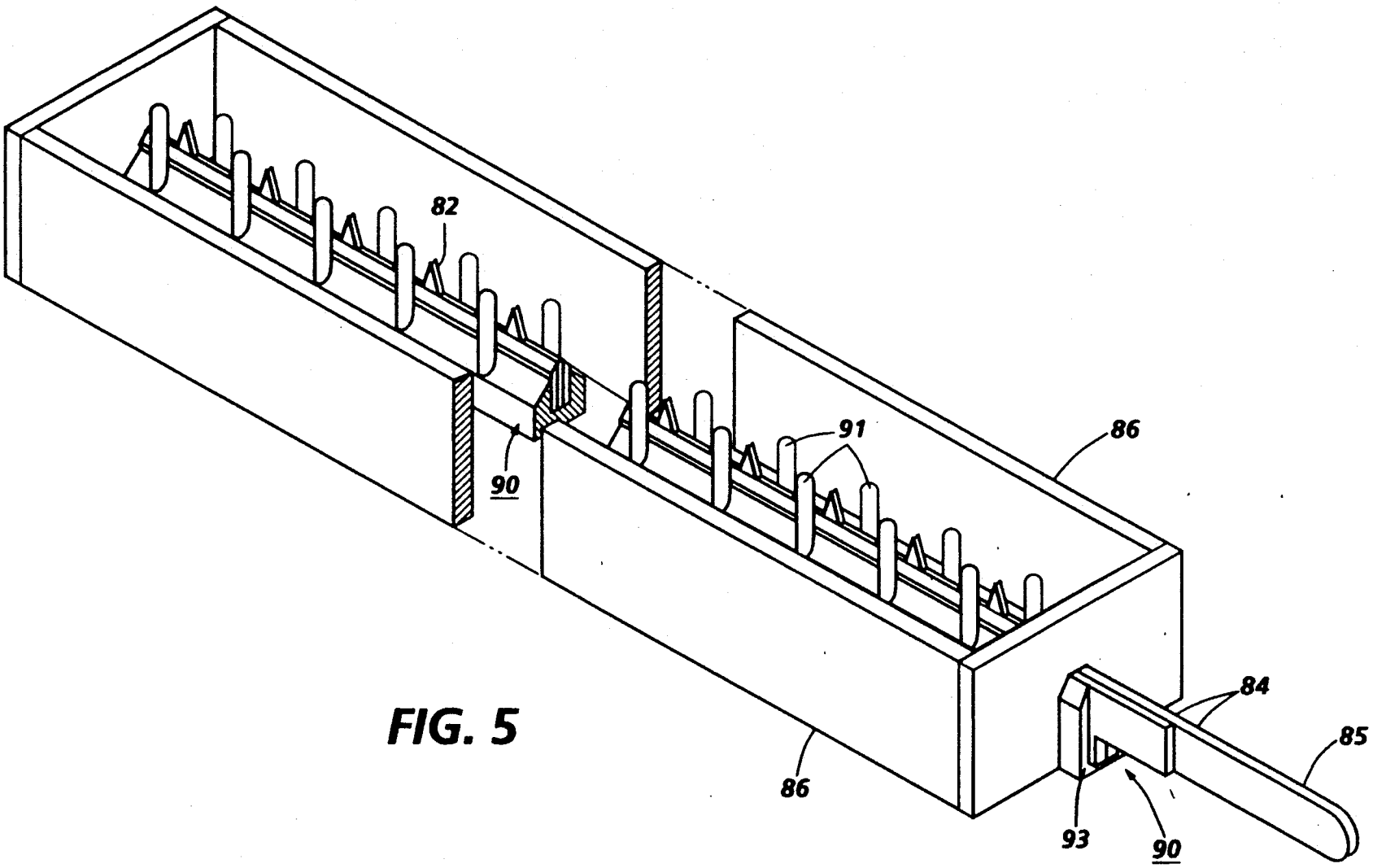
FIG. 5 is a perspective view of the corona generating assembly of the present invention.

Pin coronode 81 is coupled to a high-voltage extension member 85, best shown in FIG. 5, or may be provided with an integral high voltage extension member for electrical connection of the pin coronode 81 to a high-voltage power source (not shown). In a typical embodiment, the pin array 82 has a length approximately equal to the width of the surface to be charged, and a height sufficient to expose the teeth thereof when mounted between the side support members 84, which is required to provide proper charging characteristics. In a preferred embodiment, the pin coronode 81 has a thickness of approximately 0.08 mm (0.03 inches) and the teeth of pin array 82 extend approximately 3.5 mm (0.136 inches) from the top edge of the side support member 84 at a pin tip-to-pin tip interval of approximately 3 mm (0.12 inches). It will be understood that, although the present invention is described with reference to a pin coronode, the protective guard described in further detail herein could be used in conjunction with a wire coronode as known in the art or may be useful in other configurations outside of the realm in of corona charging assemblies.

The prior art corona charging assembly of FIGS. 1*a* and 1*b* also includes a protective lacing 88, which is generally comprised of a nonconductive material having a rectangular frame with diagonally parallel strips forming a grate, having openings between the parallel strips which are generally small enough to prevent finger and hand contact with the teeth of pin array 82. Protective lacing 88 is generally mounted on shield member 86 to cover the teeth of the pin array 82 using a complementary interlocking tab system (not shown) or other known latching method. A perspective view of the protective lacing of this prior art system is shown in greater detail in FIG. 1 of U.S. Pat. No. 4,725,732.

Figure 3:
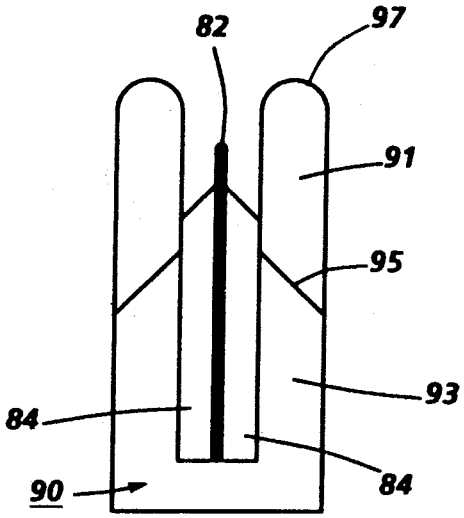
FIG. 3 is a cross-sectional end view of a pin coronode and the protective guard of the present invention.
Figure 2B:
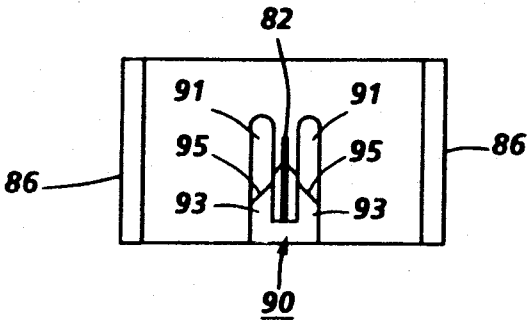
FIGS. 2A and 2B are top and side views, respectively, of the corona generating assembly of the present invention.
Figure 2A:
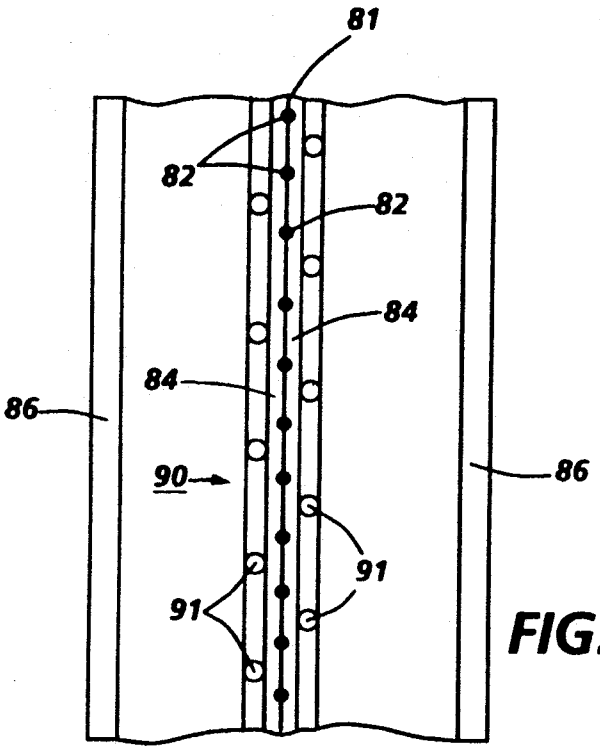
Figure 4:
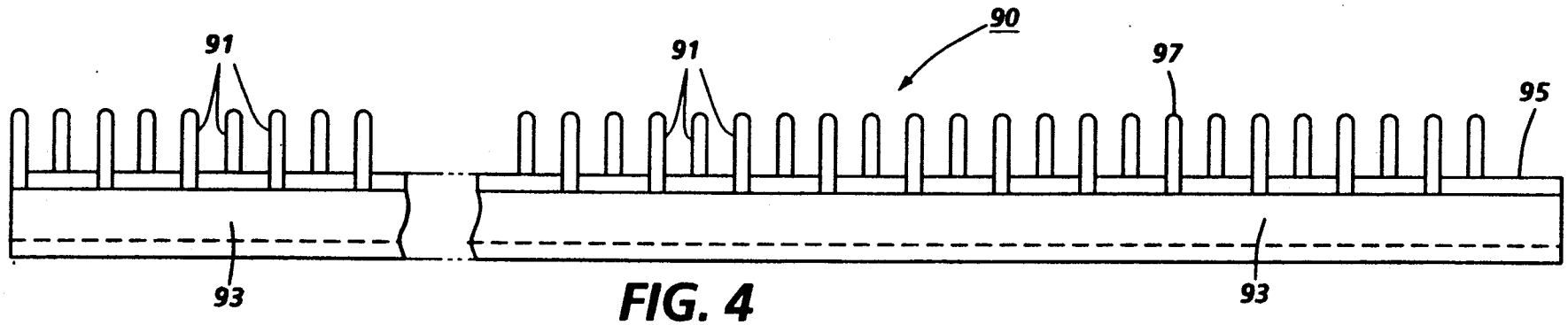
FIG. 4 is a side view of the protective guard of the present invention.

Referring now more particularly to FIGS. 2*a* and 2*b* as well as FIGS. 3–5, an exemplary corona charging assembly representative of the specific subject matter of the present invention is illustrated and will be described in greater detail. As in the prior art device, the primary components of the corona charging assembly are pin coronode 81 having a pin array 82, side support members 84, and side shield members 86. In a preferred embodiment of the present invention the corona charging assembly further includes an electrically nonconductive protective guard 90 including a base member 93 forming an open-ended aperture having fingers 91 extending therefrom. As best shown in FIG. 3, base member 93 is generally U-shaped, having a pair of opposed sidewalls and is preferably dimensioned substantially equal to the combined thickness of pin coronode 81 and side support members 84 so as to receive the coronode 81 and side support members 84 in the aperture thereof and provide a close fitting arrangement therein. A plurality of spaced finger-shaped projections 91 extend from base 93 substantially parallel to pin array 82 of pin coronode 81.

The protective guard of the present invention may be formed from any suitable durable and resilient nonconductive polymer based material, such as NORAL available from Dupont Corporation, Wilmington, Del. Although it is conceivable that the protective guard 90 of the present invention may be fabricated by extruding, milling or any other method known to those of skill in the art, the preferred method of fabrication is injection molding since molding permits the simple and inexpensive formation of spherical radii tips 97 at the protruding free-end of each finger-shaped projection 91. Spherical radii tips 97 are preferable because it has been found that planar surfaces proximate to an electric field will adversely attract the electric field and cause field breakage thereof. Thus, spherical or curved surfaces are preferable because they have a reduced attenuating effect on the electrical field generated by the pin coronode 82. In a further effort to reduce the attenuating effects of surfaces in the area surrounding the coronode, the upper edges of U-shaped base member 93 are further provided with a beveled chamber 95 in the areas between the finger-shaped projections 91. It has been found that electric fields have a reduced attraction to such beveled edges, thereby further reducing the attenuating effect of the protective guard 90 on the electric field generated by the pin coronode 81.

The assembled corotron 90 of the present invention is shown in FIG. 5 wherein pin coronode 81 and conductive side support members 84 are positioned within the aperture of base member 93. In an alternative assembly method, the pin coronode 81, side members 84 (not shown), and base member 93 can be provided with aligning slots (not shown) through which a securing pin can be inserted for securing the individual parts of the assembly. In this configuration, each end of each securing pin may be slightly oversized for locking the pin in place.

As can be seen in FIG. 5, the finger-shaped projections 91 of protective guard 90 extend beyond the height of the pin array 82 such that the pin array 82 is recessed within the protective guard 90. Clearly, since the pin array 82 is recessed between the finger elements 91 of the protective guard 90, a highly effective safety mechanism for preventing external contact with the pin array during handling of the corona generating assembly is provided. Thus, the protective guard 90 disclosed herein serves to prevent lacerations to a field technician or other person and also serves to prevent damage to the projections of the pin array 82. Further, the protective guard described herein is very inexpensive to produce relative to the protective lacing of the prior art.

In a preferred embodiment, the finger-shaped projections 91 of the protective guard 90 extend approximately 4.5 mm (0.18 inches) above the top edge of beveled chamfer 95, and approximately 1 mm above the projections of pin array 82. Each finger element 91 is approximately 1 mm in diameter and spaced approximately 6 mm from one another, on center. Maximum protection and minimal electric field attenuation is provided by alternately spacing the finger elements 91 on either side of the pin array 82 as can be seen from FIGS. 4 and 5. One of skill in the art will recognize that the dimension and positioning of the finger elements 91 can be varied and modified as desired. It will be further recognized by one of skill in the art that the side walls of the U-shaped base member can be extended to a height above the projections of pin array 82, thereby eliminating the need for finger elements 91. However, it is noted that the preferred embodiment disclosed herein has been shown to provide maximum protection with minimal effect on the electric field produced by the pin coronode 81.

In recapitulation, it should now be clear from the foregoing discussion that the apparatus of the present invention provides a novel corona generating assembly wherein a pin coronode thereof is bounded by a protective guard having a plurality of protective finger elements extending to a height which is greater than the height of the projections of the pin coronode. It is believed that the distribution, dimension, and configuration of the finger elements provide a sufficient barrier to protect against human or other external intervention of the pin array of the pin coronode while minimizing any attenuating or degradational effects on the electric field generated by the coronode.

It is, therefore, apparent that there has been provided, in accordance with the present invention, a corona generating assembly that fully satisfies the aims and advantages set forth hereinabove. While the present invention has been described in conjunction with a specific embodiment thereof, it will be evident to those skilled in the art that many alternatives, modifications and variations are possible to achieve the desired results. Accordingly, the present invention is intended to embrace all such alternatives, modifications, and variations which may fall within the spirit and scope of the following claims.

We claim:

1. An apparatus for generating ions, comprising:
an electrically conductive coronode adapted to generate ions; and
an electrically non-conductive protective guard including
a base member having a pair of opposed side elements forming a channel therebetween adapted to receive said coronode; and
a plurality of projection elements extending from each of said pair of side elements along a plane substantially parallel to said channel, each of said plurality of projection elements having a free-end with said coronode being recessed between said plurality of projection elements.

2. The apparatus of claim 1, further including a conductive shield having first and second shield members mounted on either side of, and laterally spaced from, said protective guard.

3. The apparatus of claim 1, wherein said electrically conductive coronode includes an elongate member having an array of integral coplanar projections extending along an edge thereof.

4. The apparatus of claim 3, further including at least one electrically conductive support member positioned adjacent said coronode, said support member being adapted to form electrical contact with said coronode and having an end adapted for connection to a high voltage power supply.

5. The apparatus of claim 1, wherein said electrically conductive coronode includes an end adapted for connection to a high voltage power supply.

6. The apparatus of claim 1, wherein said electrically conductive coronode includes a wire element having an end adapted for connection to a high voltage power supply.

7. An apparatus for generating ions, comprising:
an electrically conductive coronode adapted to generate ions; and
an electrically non-conductive protective guard including
a base member having an open ended aperture adapted to receive said coronode; and
a plurality of finger-shaped projections, each having a free end and each extending from said base member on opposed sides of said open ended aperture thereof with said coronode being recessed between said plurality of elements.

8. The apparatus of claim 7, wherein said finger-shaped projections of said electrically non-conductive protective guard are spaced approximately 6 mm apart, on center.

9. The apparatus of claim 7, wherein said plurality of finger-shaped projections of said electrically non-conductive protective guard are alternately interspaced on said opposed walls of said open-ended aperture such that each of said plurality of finger-shaped projections is offset from one another on either side of said open-ended aperture.

10. The apparatus of claim 7, wherein said free-end of each of said plurality of finger-shaped projections includes a spherical radii tip.

11. The apparatus of claim 1, wherein said base member includes first and second sidewalls adapted to form a U-shaped body.

12. The apparatus of claim 11, wherein said first and second sidewalls include an edge having a beveled chamfer.

13. The apparatus of claim 1, wherein said protective guard is fabricated via injection molding techniques using at least a resilient polymer based material.

14. An electrostatographic printing apparatus having at least one charging apparatus adapted to apply a charge to an adjacent surface, said at least one charging apparatus comprising:
an electrically conductive coronode adapted to apply a charge to an adjacent surface;
an electrically non-conductive protective guard including
a base member having a pair of opposed side elements forming a channel therebetween adapted to receive said coronode; and
a plurality of projection elements extending from each of said side pair of side elements, each of said plurality of projection elements having a free-end with said coronode being recessed between said plurality of projection elements; and
a conductive shield including first and second shield members mounted on either side of, and laterally spaced from, said protective guard.

15. The electrostatographic printing apparatus of claim 14, wherein said electrically conductive coronode includes an elongate member having an array of integral coplanar projections extending along an edge thereof.

16. The electrostatographic printing apparatus of claim 14, further including at least one electrically conductive support member positioned adjacent said coronode, said support member forming electrical contact with said coronode and being adapted for connection to a high voltage power supply.

17. The electrostatographic printing apparatus of claim 14, wherein said electrically conductive coronode includes an end adapted for connection to a high voltage power supply.

18. The electrostatographic printing apparatus of claim 14, wherein said electrically conductive coronode includes a wire element having an end adapted for connection to a high voltage power supply.

19. An electrostatographic printing apparatus having at least one charging apparatus adapted to apply a charge to an adjacent surface, said at least one charging apparatus comprising:

an electrically conductive coronode adapted to apply a charge to an adjacent surface;

an electrically non-conductive protective guard including a base member having an open-ended aperture adapted to receive said coronode; and a plurality of finger-shaped projections, each having a free-end with said coronode being recessed between said plurality of elements; and a conductive shield including first and second shield members mounted on either side of, and laterally spaced from, said protective guard.

20. The electrostatographic printing apparatus of claim 19, wherein said finger-shaped projections of said electrically non-conductive protective guard are spaced approximately 6 mm apart, on center.

21. The electrostatographic printing apparatus of claim 19, wherein said plurality of finger-shaped projections of said electrically non-conductive protective guard are alternately interspaced on said opposed walls of said open-ended aperture such that each said finger-shaped projection is offset from one another on either side of said open-ended aperture.

22. The electrostatographic printing apparatus of claim 19, wherein said free-end of each of said plurality of finger-shaped projections includes a spherical radii tip.

23. The electrostatographic printing apparatus of claim 14, wherein said base member includes first and second sidewalls adapted to form a U-shaped body.

24. The electrostatographic printing apparatus of claim 23, wherein said first and second sidewalls include an edge having a beveled chamfer.

25. A protective guard for preventing external contact with an elongate member comprising:

a base member having an open-ended aperture adapted to receive said elongate member; and a plurality of elements, each having a free-end and each extending from said base member on opposed sides of said open-ended aperture thereof, such that said elongate member is recessed between said plurality of elements.

26. The protective guard of claim 25, wherein said plurality of elements of said protective guard are finger-shaped projections, each including a spherical radii tip at said free-end thereof.

* * * * *